United States Patent [19]

Eber et al.

[11] Patent Number: 4,488,932

[45] Date of Patent: Dec. 18, 1984

[54] FIBROUS WEBS OF ENHANCED BULK AND METHOD OF MANUFACTURING SAME

[75] Inventors: Robert J. Eber, Appleton; Bruce W. Janda, Neenah, both of Wis.

[73] Assignee: James River-Dixie/Northern, Inc., Norwalk, Conn.

[21] Appl. No.: 409,055

[22] Filed: Aug. 18, 1982

[51] Int. Cl.[3] ..... D21C 9/00

[52] U.S. Cl. ..... 162/9; 162/13; 162/100; 162/101

[58] Field of Search ..... 162/10, 13, 9, 100, 162/201, 101

[56] References Cited

U.S. PATENT DOCUMENTS 1,980,881 11/1934 Schur ..... 162/201

4,036,679 7/1977 Back et al. ..... 162/9

*Primary Examiner*—Peter Chin

*Attorney, Agent, or Firm*—William A. Aguele; Harry W. Hargis, III; Thomas H. Whaley

[57] ABSTRACT

Fibrous webs of improved bulk and softness are produced by subjecting hydrophilic papermaking fibers to mechanical deformation, e.g. hammermilling, sufficient to deform the fibers without substantial fiber breakage, dispersing the resulting curled or kinked fibers, preferably in admixture with conventional papermaking fibers, in an aqueous foam with minimal agitation and holding time and forming a wet laid web from the resulting fiber furnish.

13 Claims, 4 Drawing Figures

FIBROUS WEBS OF ENHANCED BULK AND METHOD OF MANUFACTURING SAME

This invention relates to fibrous web products of enhanced bulk and superior formation containing conventional papermaking fibers in combination with at least 10% by weight of mechanically deformed hydrophilic papermaking fibers (treated fibers), characterized by kinks, twists, curls, crimps, or other deformations of an essentially temporary nature, and to a process for making such fibrous web products. In one of its more specific aspects, this invention relates to a method for the production of fibrous web products of enhanced bulk and superior formation as compared with conventional products and comprising from about 25 to about 75% by weight treated natural cellulose fibers which have been mechanically deformed, and from about 75 to about 25% by weight untreated conventional cellulosic pulped fibers. In another of its more specific aspects, this invention relates to a process adapted to utilize said treated fibres in a wet papermaking process under such conditions that the treated fiber deformations, essentially of a transient nature in an aqueous environment, are effectively utilized to provide the bulk enhancement. In one of its still more specific aspects, the present invention relates to an improved process for the production of high bulk fibrous web products wherein conventional hydrophilic fibers suitable for the making of paper are treated mechanically to impart short-lived deformations in the fibers which are then mixed with conventional, essentially linear, cellulosic papermaking fibers in a foamed dispersion and the resulting dispersion of mixed fibers dispensed onto a moving foraminous forming means to form a wet web of enhanced bulk and superior formation. The wet web is then processed conventionally to a product web having enhanced bulk as a consequence of the presence of treated fibers incorporated in the product.

In the manufacture of fibrous webs, for example, paper web products, such as paperboard and tissue products, conventional processing techniques dispense a dilute furnish consisting of an aqueous slurry of hydrophilic fibers, e.g., cellulosic fibers, onto a moving foraminous wire support means. Water drains through the support means, often aided by application of a vacuum thereunder, the deposited fibers forming a wet web on the wire. The wet web is dried subsequently, and, if desired, the web leaving the drier can be creped to achieve additional bulk and softness.

In the process disclosed in U.S. Pat. No. 3,716,449 to Gatward et al, incorporated herein by reference, the papermaking fibers are uniformly dispersed in an aqueous solution of a foamable water-surfactant and the foamed liquid containing the fibers is dispensed onto a moving foraminous support means.

In both of these alternate processes, the wet web, prior to the thermal drying step on a Yankee or other drier means, is often wet pressed by means of consolidation rollers to remove a portion of the residual water from the wet web thereby reducing drier load. As a consequence of wet pressing, a web of greater strength and density may be made, but the bulk of the product web is reduced. High bulk is desirable in many paper products to achieve high liquid holding capacity, and relatively low fiber content per ream of web product.

Kinked, bent, curled and otherwise distorted hydrophilic fibers, for example, natural cellulose fibers, can be obtained by various known chemical and mechanical treatment methods. For example, U.S. Pat. No. 2,516,384, Hill et al, discloses a wet treating method wherein conventional pulp fibers are wet worked into small, discrete nodules of fibers, which are then compressed and rolled to contort the fibers. U.S. Pat. No. 3,028,632, Coghill, describes a machine for processing wood pulp according to the method of Hill et al. When employed in conventional wet papermaking processes, treatment of wood pulp fibers by the process of U.S. Pat. No. 2,516,384 does not enhance the bulk of the product web as compared with webs produced from untreated fibers apparently because of the tendency of the wet treated fibers to revert to their original configuration with time as discussed in U.S. Pat. No. 4,036,679, Back et al.

Present practice in the manufacture of webs having enhanced bulk and softness is to treat the bulk enhancing fibers mechanically or chemically under conditions which produce essentially permanently kinked or curled treated fibers. In the process of U.S. Pat. No. 4,036,679, for example, cellulosic fibers are kinked curled by defiberizing a pulp having a consistency of 60 to 90% fiber by weight in a high energy system, such as a disc refiner whereby the kinks and curls remain for about 24 hours when placed in an aqueous system before relaxing to their original character. An analogous process is described in U.S. Pat. No. 3,382,140, Henderson et al, wherein fibrillated kinked fibers are produced by refining at a consistency of between about 10 and 60% fiber by weight. An alternate approach is exemplified in U.S. Pat. No. 3,455,778 to Bernadin wherein the fibers are treated chemically to permanently establish kinked fibers which are compatible with conventional wet laid technology.

It is also known that defiberized fibers employed in air laid web forming processes have a degree of contortions which contribute to the high bulk of air laid webs. In the production of air laid webs, latex or other artificial bonding agent must be added to the formed web due to the inability of the individual fibers to bond naturally by means of hydrogen bonding. In the conventional wet laid papermaking process, the defiberized fibers of the air laid process are not useful because the kinks and curls of the defiberized fibers relax significantly during the process. It is also known that conventional wet milling of papermaking fibers produces treated fibers containing kinks and curls of transient duration in an aqueous environment. The energy required for wet milling is generally not of the type and of the severity necessary to permanently kink the fibers.

The present invention relates to a process for the manufacture of fibrous webs of enhanced bulk in which treated hydrophilic fibers, characterized by kinks, curls, bends, twists or like deformations are dispersed in an aqueous foam which minimizes water absorption and consequent reversion of the treated fibers to their original form, and the dispersion dispensed onto a moving foraminous support means to form a fibrous web. At least 10 percent by weight treated fibers are incorporated into the web to form a product having high bulk, high porosity, and a high absorbency. The process results in a product possessing greater bulk, softness and absorbency than conventional wet laid web products although with some sacrifice of tensile strength.

In carrying out the process as it may be applied to cellulosic paper web products, two distinct types of fibers are employed, although the source of the fibers may be identical. The preferred first type of fiber is conventional bale pulp papermaking fibers as may be produced by the sulfite, sulfate or other processes. Characteristically, the conventional fibers are hydrophilic and essentially linear, with a fiber length between about 1.0 to 6.0 mm. The second type of fibers (treated fibers) are also hydrophilic, and are preferably cellulosic fibers characterized by kinks, curls, twists or other intorsions. Although the length of the preferred treated cellulosic fibers in a relaxed state may also be about 1.0 to 6.0 mm, their length in the compressed or deformed state is considerably reduced. The treated fibers can be obtained mechanically by wet or dry milling, preferably by defiberizing laps or bales of conventional otherwise untreated hydrophilic fibers in a hammermill or an equivalent device.

In the process of this invention for making paper webs, conventional cellulosic pulp is treated in a pulper for less than about one hour at a consistency of between 2 to 6 weight percent water and then transferred to a machine chest for storage for up to about six hours or more. The consistency of the slush pulp is subsequently increased to between about 8 to about 55% by weight in a stock press, and then transferred to a mix tank into which the treated hydrophilic fibers, preferably natural cellulose fibers, are also added, along with sufficient diluent to achieve a consistency of between about 0.3 to about 4% fiber by weight. The forming medium is a foamed dispersion comprising air, water and surfactant.

In a preferred continuous process embodiment of this invention, steady state operation is achieved such that there is a closed loop system containing the aqueous foam which is reconstituted in a silo prior to addition of the foam to the mix tank and dilution of the fiber dispersion. Parameters of the mixing step are treated fiber residence time, nature and severity of agitation, and process temperature. These parameters are combined such that during the time interval between incorporation of the treated dry fibers into the aqueous foam in the mix tank and discharge of the final dilute foamed dispersion through the forming header onto the forming wire, the treated hydrophilic fibers retain at least a part of the deformation induced in them. Treated fiber residence time in the mix tank should generally be no greater than 10 minutes, preferably no greater than 5 minutes, under mixing conditions adapted to minimize relaxation of the kinks and curls. If necessary, the uniform dispersion leaving the mix tank is further diluted with foam from the silo to achieve a consistency of between 0.3 to 1.2% fiber by weight, transferred to a forming header, and dispersed onto a moving foraminous support means to form a wet web, a major portion of the foamed dispersion passing through said support means for return to the silo and recyling. The wet laid web then follows a conventional path through the remainder of the web manufacturing process.

The products thus produced by this process have greater bulk than products made in like manner with only conventional papermaking fibers, and show significantly superior formation.

BRIEF DESCRIPTION OF DRAWINGS

The process of this invention will be more readily understood with reference to the drawings, wherein.

Figure 1:
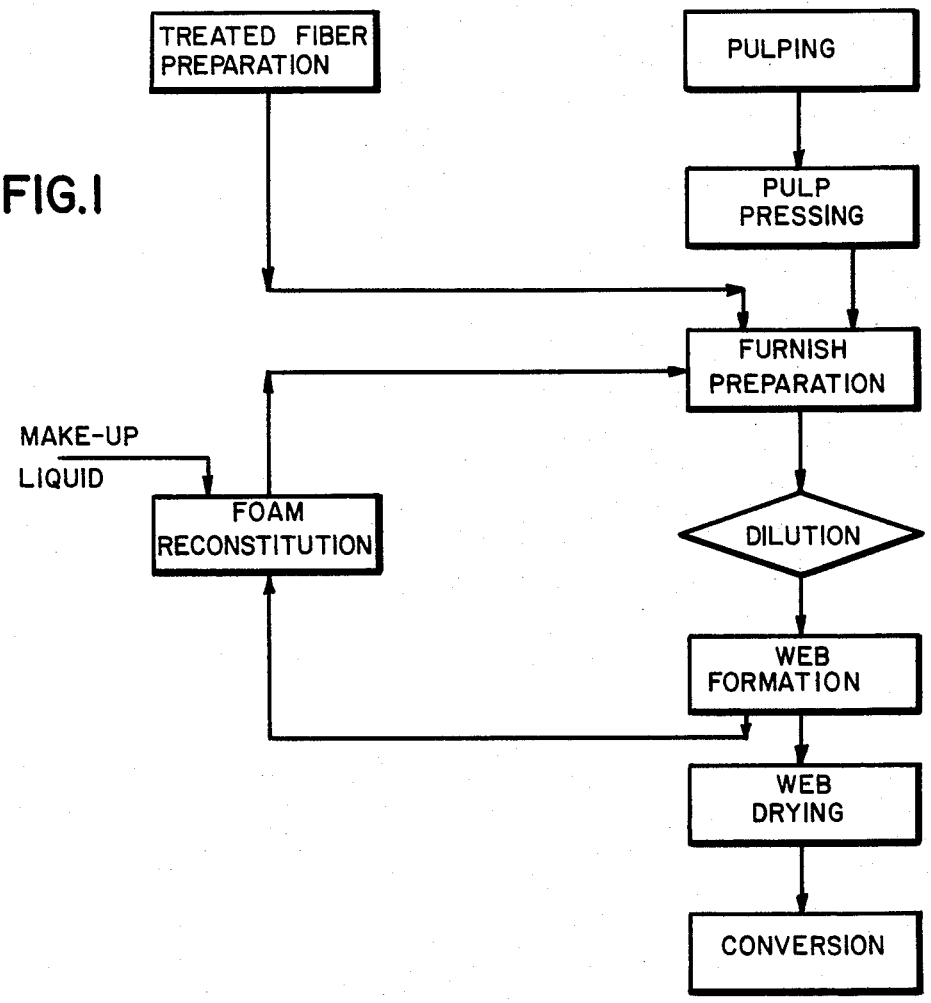
FIG. 1 is a block flow diagram of the process.

The present invention contemplates the inclusion of two distinct types of fibers within a fibrous web. The first type of fibers comprises conventional, essentially linear fibers commonly used in the art of manufacturing fibrous webs. Typically, such conventional fibers are natural cellulosic fibers, such as those obtained from wood pulp, cotton, hemp, bagasse, straw, flax and other plant sources. The wood pulp fibers can be derived from either hardwood or softwood pulps, and generally have fiber lengths ranging from about 1.0 to 6.0 mm. The pulps may be obtained from any of the conventional processes for preparing said fibers, for example, groundwood, cold soda, sulfite, or sulfate pulps, and may be bleached or unbleached.

In addition, the first class of conventional fibers may include synthetic fibers such as polyester, polypropylene, polyethylene, polyamide, and nylon fibers, as well as chemically modified cellulosic fibers such as rayon, cellulose acetate, and other cellulose ester fibers. These synthetic and modified natural fibers are now used commonly in the manufacture of fibrous webs, either alone or in combination with natural cellulosic fibers when specific attributes of the web are desired. For example, a blend of synthetic and natural cellulosic fibers is advantageous to obtain a multi-use, ultimately disposable, industrial wipe. The synthetic fibers provide absorbency. The conventional fibers incorporated into the webs of the present invention may be hydrophobic or hydrophilic, although for webs traditionally perceived as paper products, hydrophilic natural cellulose fibers are employed.

The second class of fibers are non-fibrillated hydrophilic papermaking fibers which have been treated in a manner as to provide kinks, twists, curls, or other intorsions, and may be derived from the above mentioned conventional fibers which are hydrophilic. Hence, the class of treated, i.e., anfractuous, fibers includes all of the natural cellulose fibers referred to above as well as chemically modified cellulosic ester fibers, which fibers are generally considered hydrophilic when the degree of substitution of hydroxyl groups present therein is less than about 1.0. The plurality of intorsions present among the treated fibers provides said fibers with three dimensional characteristics not present substantially in the first class of conventional (untreated) fibers which are structurally ribbon-like. When laid in a web the conventional fibers tend to lie flat within the web along the x-y plane. Conversely, the treated fibers are randomly distributed three dimensionally within the web. That is, there is substantial penetration of the treated fibers into the plane of the web (the z plane).

The treated fibers are further characterized in that the degree of treatment is sufficient to create the kinks, curls and other intorsions, yet is not so severe that the fibers become permanently kinked. Thus, because the treated fibers are hydrophilic, they tend to return to their original shape in a relatively short time after they are slurried in an aqueous medium. The rate of relaxation of these relatively short-lived intorsions is relatively rapid during the first few minutes after they are wet with water, but is dependent on a number of factors including the severity of treatment during preparation, the consistency of the slurry, the presence or absence of agitation, the severity and nature of said mixing (if any), the temperature of the aqueous medium, the presence of wetting agents, and the like. However, even under essentially ideal conditions of no agitation and ambient temperature, but at conventional process utilization consistency, i.e., consistencies less than about 10% by weight, the intorsions relax consideraly with about 1 to about 10 minutes in a water environment. Conventional web manufacturing methods, which require pulping and storage operations that proceed over several hours, typically one to six hours with vigorous agitation, are thus contrary to the intrinsic nature of the treated fibers utilizable in the present invention.

The present invention resolves the relaxation problem, not by special treatment of the fibers, but by recognition of the relaxation mechanism, and the utilization of a novel process compatible with transiently kinked fibers. Quite surprisingly, the method of utilization not only establishes the long sought improvement in web bulk, but also provides products that have additional elements of novelty and uniqueness.

The treated fibers may be obtained by mechanically shearing laps, rolls, bales or sheets made from treatable fibers (as defined above) such that the resulting individual fibers have a substantial degree of twists, kinks, curls and bends. It is a requisite that the means used to prepare the fibers not fibrillate them to any substantial degree, the presence of fibrils being antithetical to the bulk enhancement properties of the fibers. Various refining and hammermilling methods known in the art can be used to provide short-lived anfractuous characteristics to the fibers.

The preferred means for preparing the treated fibers is to defiberize dry laps made from treatable fibers in a hammermill. As used in the preceding sentence the term "dry" means that no free water is present in the fibers, although the laps, bales or the like will normally contain as much as about 15% equilibrium moisture by weight as a result of storage under atmospheric conditions.

The intorsions provided by this means are occasioned predominately by the shearing forces upon the fibers as they pass between the anvil and rotating hammer. When cellulosic treatable fibers are conditioned in this manner, it is believed that the high temperatures within the hammermill, usually between 150° to 210° F., and resulting from the dissipation of mechanical energy as thermal energy, enhance the effect produced by the shearing forces alone by eliminating some hydroxyl groups associated with the cellulose, thus introducing additional constrictive and contortive forces upon the individual fibers.

The average residence time of the fibers in the hammermill is preferably less than about one second, thus providing a rapid method and means of preparation, which method may easily process between 100 and 500 pounds of treatable fibers per hour per hammermill. Other factors affecting the severity of treatment are the fiber size, degree of shear imparted to the fibers, temperature within the hammermill, the identity of the fibers and their moisture content. Leaving the hammermill, the moisture content of the fibers is about 1 to 5% by weight, and is essentially a function of the equilibrium moisture content of the particular fiber at the mill temperature.

As an alternate to hammermilling, the treated fibers may be produced by wet milling in a disk refiner. The preferred wet milling apparatus is a Chemifiner manufactured by Black Clawson Corporation. In the Chemifiner, fiber curling and kinking is accomplished by subjecting a nodular mat of pulp to gyratory motion under compression between a division disk and a hydraulically loaded eccentrically opposed "floating disk" rotating in the same direction at nearly the same speed. The patterned faces of the disks provide tractive surfaces so that the pulp nodules are continuously reoriented as they roll and traverse from the center inlet port to the peripheral discharge zone. Pulp consistency is typically between 15 and 50% fiber by weight, preferably between 30 and 45% by weight. Maximum hydraulic loading pressure is about 50 psi, while the floating disk rotates at a speed of between 100 to 500 ft./min. An eccentricity of 0.075 inch has been used to obtain suitably kinked fibers. Disk clearance is variable but generally should be less than 0.1 inch, preferably about 0.07 inch.

In a preferred embodiment of the process of the present invention, the treated kinked fibers as well as untreated conventional fibers are dispersed within a foamed liquid media comprising water, air and surfactant, the resulting foam furnish being dispensed onto a moving foraminous forming means to obtain a wet web of about 12% fiber by weight. Excess liquid draining through the foraminous forming means is collected and recycled in a closed loop system. For reasons hereinafter described, the preferred foraminous forming surface is of the twin wire type, that is, two separate foraminous wires converging to form a nip, the furnish being jetted into the nip from a forming header provided with an injection nozzle. The wet web is then dried conventionally, the ultimate web product having a moisture content of about 5% water by weight. Standard processing treatments that may be performed on the web between forming and take-up on a parent roll include wet pressing, consolidation, embossing, and creping, each such operation being well known in the art of web manufacturing.

The web product comprises at least 10% by weight of the treated fibers described previously, the remaining 90 to 0% by weight of the web being the aforesaid untreated conventional fibers. Preferably, the weight rates of treated to untreated fibers is in the range about 3:1 to 1:3.

FIG. 1 is illustrative of the process, illustrating the sequence of principal operating steps in block diagram format. Referring to FIG. 1, a pulp of untreated fibers, as hereinbefore defined, is first prepared in a manner conventional in the art. The pulp may be obtained directly from existing mill operations, or may be prepared from laps, bales, or rolls of untreated fibers in a repulping operation. Typically, the pulp slush thus obtained has a consistency of between about 3.0 to about 6.0% untreated fiber by weight. Because a closed loop furnish system is used, the consistency of the untreated fiber slush pulp must be high enough to ensure that a surplus of water will not develop within the loop. For this reason the pulp is pressed to a consistency of between about 8 to about 50% fiber by weight, preferably between 15 to 35%.

The high consistency slush pulp of untreated fibers is then dispersed within the foamed media along with treated fibers. In the preferred embodiment a portion of the foamed liquid recovered from the forming apparatus is used to provide a furnish predilution consistency of between about 1.5 to about 4.0% fiber (treated and untreated) by weight, the remaining portion of foamed liquid subsequently being used to further dilute the furnish to a final (headbox) consistency of between about 0.3 to about 1.2% by weight. The wet web is then laid as mentioned above. Any deficit in water and/or surfactant circulation in the closed loop system is made up continuously by addition to the foamed liquid collection apparatus.

Figure 2:
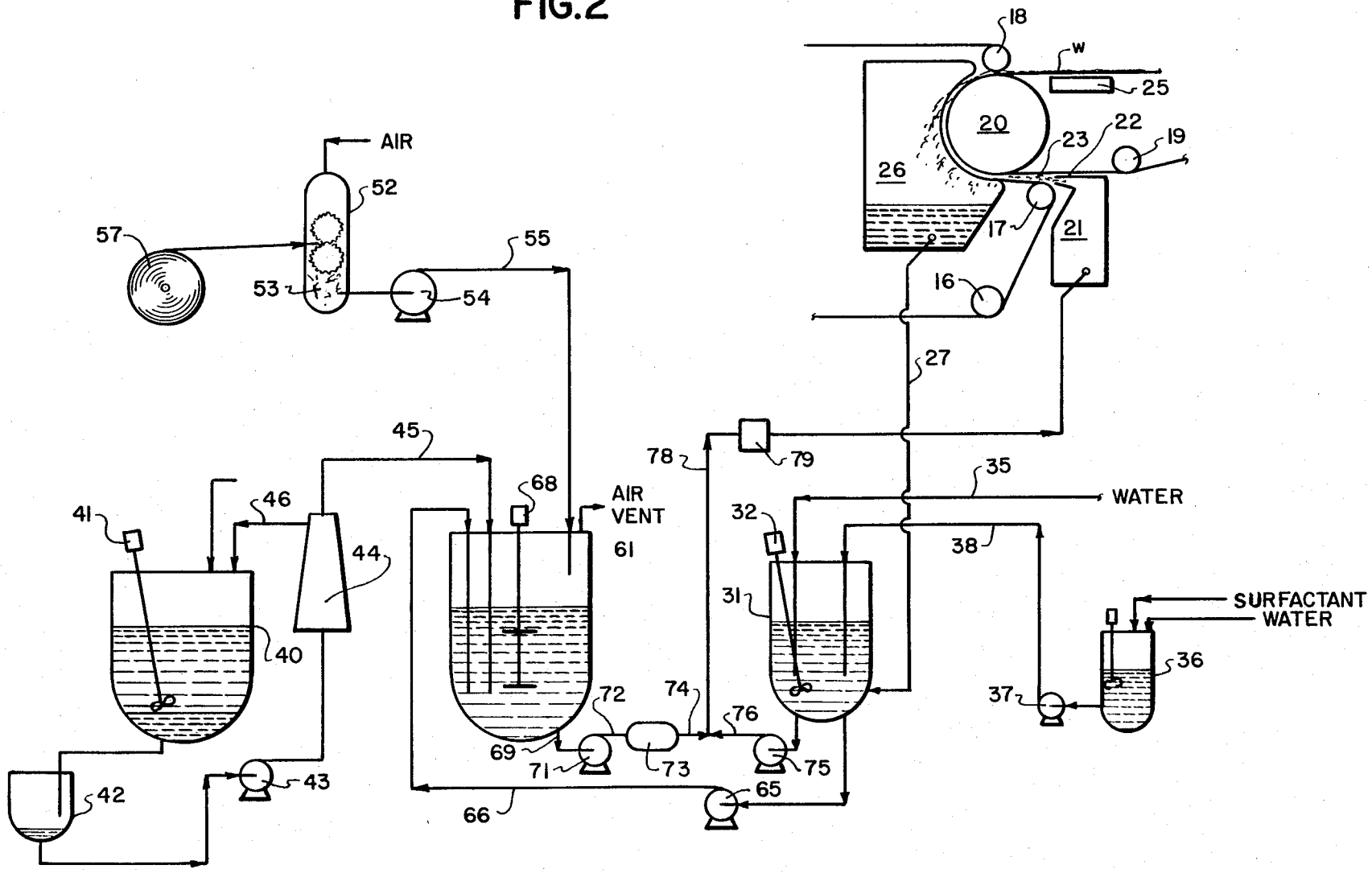
FIG. 2 is a detailed flow diagram of the process wherein a twin wire forming means is employed.

Reference is now made to FIG. 2, a detailed flow diagram of the preferred embodiment of the process. The apparatus of the process as well as the process start-up procedure developed to initially generate the foam medium is described in commonly assigned pending U.S. patent application Ser. No. 179,229 entitled "Apparatus and Method for the Manufacture of a Non-Woven Fibrous Web", filed Aug. 8, 1980 by James Cheshire et al, which application is incorporated herein by reference. In the steady state operation of the process of FIG. 2, the foamed furnish of about 0.3 to about 1.2 weight % consistency is jetted into a nip 14 formed between converging endless foraminous wires 11, 12 from headbox 21. Wire 11 is supported by rolls in conventional manner, rolls 16, 17, 18 being shown. Similarly, wire 12 is supported by rolls, only roll 19 being shown in FIG. 2. The support rolls are positioned such that the wires 11, 12 are caused to wrap around a portion of a smooth impervious cylindrical forming roll 20. In FIG. 2, the wire 12 is in direct contact with roll 20 (i.e., the inner wire), while the wire 11 (the outer wire) is superposed on wire 12. Rolls 16, 17, 19 and 20 are situated such that the nip 14 is formed tangential to roll 20, the nozzle 22 of headbox 21 jetting the furnish 23 into said nip, thereby distributing the fibers contained herein randomly betwen the wires 11, 12. The larger portion of the foamed liquid is pressed or squeezed from between the wires as they travel about the impervious roll 20, passes through the outer foraminous wire 11, and into a saveall 16 proximate to said wire 11. A minor portion of the liquid, essentially water with a low concentration of surfactant, is retained within the distributed fibers. As the wires 11, 12 diverge at roll 18, a wet web W is caused to remain on support wire 12 by application of vacuum in vacuum box 25, although it is also possible for web W to follow the path of wire 11 if desired. Web W contains between about 85 to about 93% water by weight, the remainder being the fibers and small amounts of surfactant. Some liquid is withdrawn by the vacuum means, and may be returned to the system (not shown). The wet web W is processed subsequently in a manner conventional to the art, ultimately being dried to less than about 3% to about 10% moisture by weight.

Foamed liquid collected in the saveall 26 is withdrawn therefrom via line 27 and is directed to a silo 31, the inlet thereto being in the lower region of silo 31 and below the liquid level therein. Make-up water is added to the silo 31 through line 35, while make-up surfactant solution is added from surfactant mix tank 36 via pump 37 through line 38. An agitator 32 is provided in silo 31 to mix the contents thereof.

A pulp of untreated fiber is prepared conventionally in pulp tank 40, the consistency thereof being about 1.0 to 4.0% fiber by weight. A well mixed dispersion of the fiber is obtained by high shear agitator means 41. The pulp may be prepared as part of an integrated mill operation, or may be made by repulping laps, bales or rolls of dried untreated fibers. In the latter case of a repulping operation, a uniform fiber slurry is obtained by vigorous mixing for at least 15 minutes, preferably 30 minutes or longer. Typically, the pulping operation is performed batchwise, the slush pulp being subsequently stored in a machine chest 42 having storage capacity of three to six hours or more to provide an always available supply of pulp. The slush pulp is withdrawn from tank 40 (or from the machine chest, if used) by pump 43 and is directed to a stock press 44. Leaving the stock press 44 through line 45, the pulp has a consistency sufficient to require the addition of make-up water and surfactant solution to the closed loop foam system via lines 35 and 38 respectively. A suitable stock press is available from Arus-Andritz. The consistency of the pulp in line 45 can be calculated easily by material balance. In general, however, the consistency is between 8 and 50 weight %, preferably between 15 and 35 weight %. Water removed from press 44 is recycled to the tank 40 through line 46, while the high consistency pulp of line 45 is introduced to the mix tank 61 well below the liquid level therein. It is, of course, apparent that where webs of 100% treated fiber are to be made, that the above described pulping or repulping procedures are not required.

Concurrently with the preparation of untreated fibers, treated fibers are prepared for introduction into mix tank 61. In the preferred embodiment, untreated pulp laps or bales 57 are defiberized in a hammermill 52 in a manner so as not to substantially create fibrillation of the fibers as mentioned above. Individual fibers 53, now having the anfractuous characteristics hereinbefore described, are transported pneumatically in duct 55 via blower 54 to mix tank 61, wherein they are added above the liquid level therein. Transport air is withdrawn from tank 61 through vent 63.

Foamed liquid from the silo 31 is transferred by pump 65 through line 66 to tank 61. Pump 65 is of the twin screw type capable of transferring low density liquids such as the foamed liquid. The volume of foamed liquid thus transferred is that amount necessary to obtain a mix tank consistency of between about 0.3 to about 4.0% fiber by weight, preferably between 1.5 to 4.0%. An agitator 68 provides the requisite energy to disperse the fibers rapidly, but gently such that wetting of the treated fibers is minimized as is hereinafter described. The foamed furnish of treated and untreated fibers leaves the mix tank 61 by line 69, a twin screw pump 71 providing the motive energy therefor. The discharge from pump 71, line 72, is directed to a deflaker 73, which is a very low residence time, high shear device capable of breaking apart bundle or clumps of fibers that may exist, and which would ultimately compromise the formation quality of the wet web W. The deflaker 73 comprises a plurality of disks with interlocking protruding fingers, through which the fiber bundles pass. The residence time in the deflaker is quite low, being on the order of a few seconds at commercial flow rates. A suitable deflaker is available from Impco-Escherwyss.

In the preferred embodiment, that is, where the mix tank consistency is between 1.5 to 4.0% fiber by weight, additional foamed liquid is pumped from the silo 31 by twin screw pump 75 through line 76, and is combined with the deflaker discharge, line 74, the combined streams 78 being introduced to headbox 21. Screen 79 is provided in line 78 to remove debris therefrom, which debris may cause mechanical problems in downstream equipment as well as poor product webs. The flow rate in line 76 is such that the furnish of line 74 is further diluted to a final (headbox) consistency of between about 0.3 to about 1.2% by weight. Where the mix tank consistency is less than 1.2% fiber by weight, further dilution is not required.

It has been found that utilization of the process flow scheme just described, within operating constraints outlined below, does not afford sufficient opportunity for relaxation of the treated fibers which, if laid conventionally, would lose their short-lived distortions and their high bulking attributes. It has also been found that, notwithstanding the coarser nature of the treated fibers occasioned by defiberization or other treatment performed thereon, that the webs obtained by the present process have superior formation quality as compared with webs not containing treated fibers, and prepared by the conventional wet laid process.

Although not fully understood, several parameters have been identified which tend to maximize retention of the kinked or distorted characteristics of the treated fibers. For example, the rate of relaxation of the treated fibers in an aqueous medium increases as furnish temperature increases. Hence, it is preferable that the furnish temperature be as low as possible consistent with the generation of foam, that is, furnish temperatures should be between about 60° to 120° F., most preferably at about ambient temperature conditions. The duration of treated fiber contact with the aqueous media is a second important parameter, and is related intimately with the mixing conditions within the process, particularly within the mix tank 61. Finally, the use of foam and its quality at various locations in the process sequence is important to the high formation quality of the webs and quite desireable for the maintenance of the bulking characteristics of the fibers. It is to be understood that these parameters are interelated, and that some degree of experimentation is required to optimize the process operating conditions.

The foam used herein comprises air, water and surfactant. The properties of the foam are dependent on air content, ranging between 55 and 75% by volume; the bubble size, ranging between 20 and 200 microns in diameter, and the surfactant selection. The surfactant may be anionic, nonionic, cationic or amphoteric, provided it has the ability to generate a foamed dispersion. A preferred ionic surfactant is an alpha olefin sulfonate marketed under the trade name "Ultrawet A-OK", by Arco Chemical Company, Philadelphia while a preferred non-ionic surfactant is a peg-6 lauramide, marketed under the trade name "Mazamide L-5AC" by Mazer Chemical Co., Chicago. The concentration of surfactant in the silo 31 is about 150 to 450 ppm (parts per million) by weight, and varies within the process depending upon the material balance. About 4 to 22 pounds or surfactant per ton of dry fiber in web W is lost from the system and is made up through line 38. Bubble size and air content vary throughout the closed loop, and are self-regulating.

As the liquid passes through wire 11 into saveall 26, air within the perforations of the wire 11 and ambient air is entrained in the liquid as it is drawn into the saveall 26, thereby increasing the air content of the foam to between about 70 to 75% by volume. The foam is transferred to silo 31, the larger sized, more unstable bubbles stratifying in the upper region of the silo, forming a frothy layer. Because these large bubbles are low in liquid content, they tend to collapse, the liquid therein returning to the lower silo region.

Liquid residence time in the silo is about 20 seconds, which time is sufficient to introduce make-up water and make-up surfactant solution. The removal of excess air and the introduction of surfactant, along with agitation by agitation means 32 provides a foam of about 55 to about 70 percent air by volume, preferably between 60 and 70 percent, with bubbles ranging in size between about 20 to about 200 microns, but typically averaging about 50 to 150 microns. The surface tension of the foam is within the range of from about 20 to about 70 dynes/cm. The foam in silo 31 has a relatively low viscosity as a consequence of the relatively large bubble size, the viscosity being in the range of about 10 cps (centipoises) to about 200 cps as measured by a Brookfield LVS viscometer. The average viscosity of the foam at room temperature as measured by a Ford No. 4 Cup is within the range of 9.3 to 11.3 seconds. In mix tank 61, the foam has substantially the same air content and bubble size quality as in silo 31, the amount of water added with the untreated fibers through line 45 being minor in comparison to the water in recycled foam added through line 66. At the viscosity values of the foam in mix tank 61, the untreated fibers, and more importantly, the treated fibers from duct 55 can be dispersed rapidly and at low shear. Hence, residence time is quite low in mix tank 61, typically below 5 minutes, preferably below 3 minutes, for greater retention of the high bulk properties of the treated fibers. Retention of the treated fiber characteristics is furthered by the utilization of foamed liquid as the dispersing media, the bubbles in the foamed liquid apparently adhering to and forming a film on the surface of the fibers, particularly the treated fibers, thereby decreasing the potential for fiber wetting even in the presence of mild agitation.

Care is required in the design of agitator means 68, said means being adapted to provide good dispersion of the fibers. For best dispersion, a mix tank consistency of between 1.5 to 3.5% by weight is preferred. Recommended agitation means are low shear agitators, e.g. a "Lightnin" ® mixer marketed by Mixing Equipment Co. Inc., vertical offset mounting with multiple level axial flow impellers in a baffled tank. Variable speed agitation drives are desirable to allow adjustment to minimum mixing energy required for blending the fiber dispersion and operation at energy levels such that turbulence is minimized, yet is sufficient to adequately disperse the fibers. Turbulence is also minimized by proper design of the mix tank 61, particularly with respect to the positioning of baffles therein. It is to be understood that the measurement of turbulence in agitated vessels is quite empirical, and is dependent on the system under investigation. Furthermore, the nature of the foam, which is a non-Newtonian fluid, increases the complex relationships between fluid properties and vessel geometry. Hence, empirical equations developed for Newtonian fluids relating to Reynold's Number to turbulence are not applicable. Although design of the mix tank is well within the knowledge of those skilled in the art of agitated vessel design, preliminary experimentation is required.

At a consistency above 1.5% in mix tank 61, several advantages are realized. First, the size of the mix tank and accompanying equipment is reduced, and the ability to rapidly disperse the fibers enhanced, mixing energy is reduced, and the turbulence minimized. The foam bubbles are acted upon by shear which helps maintain fine bubble size foam structure while the fibers are more or less protected from direct shearing action so that alteration of the fiber structure is less than in a conventional water dispersion. Finally, inasmuch as the foamed liquid is shear sensitive, less of the foam ultimately transferred to headbox 21 will be altered by the mixing performed in the mix tank 61. This is so because the ratio of the foamed liquid flow rate of line 76 to line 66 is from about 10:1 to about 6:1 in the preferred process embodiment. Hence, when foam from silo 31 is combined with the furnish from line 74, the foam within line 78 will have substantially the same quality as in silo 31.

The deflaker 73, which is optional but preferred, is a high shear device but as the residence time of furnish therein is a matter of a few seconds, the energy input imparted to the dispersion by the deflaker has little influence on the properties of the treated fibers. The shear has a slight although noticeable effect on the foam properties, especially viscosity, which increases in value. Therefore, diluent foam added via line 76 is preferably added downstream of the deflaker 73 to essentially re-establish the foam properties extant in silo 31 as mentioned above.

The final (headbox) furnish in line 78, whether or not subject to dilution from line 76, is at a consistency of about between 0.3 to about 1.2% fiber by weight, and has a viscosity of about 10 cps to about 35 cps on a fiber free basis. Because of the head induced by pumps 71, 75, the bubble size of the foamed liquid, which is a compressible fluid, is reduced to about 20 to about 200 microns, the averaging bubble size being in the range of about 50 to about 100 microns. Of course, the bubble size increases as pressure decreases during passage of the foamed liquid through line 78. The pressure drop through nozzle 22 is about 5 to 25 psi (pounds per square inch), preferably 10 to 20 psi. As the foam expands across the nozzle, the bubbles become larger and the density and viscosity of the foam decreases. Hence, the level of turbulence in the nip 23 which directionally is predicted by Reynold's Number is less than would be expected and relaxation of the treated fibers is again minimized. The fibers are thus distributed randomly but uniformly between the wires 11, 12, the resulting web having less flocculation of individual fibers therein.

Figure 3:
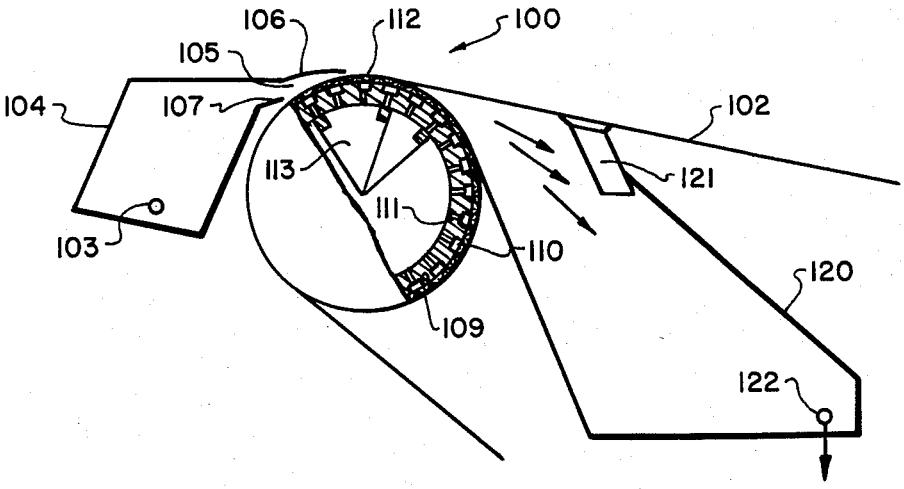
FIG. 3 is a diagrammatic illustration of a single wire forming means to which the process of FIG. 2 may be applied.

FIG. 3 illustrates an alternate arrangement of a forming apparatus 100 comprising a single wire adapted for use in the present invention. Apparatus 100 is of the suction breast roll type wherein a single forming wire 102 partially encircles a breast roll 119, said wire 102 further being suggested and driven by additional guide rolls (not shown) of known construction. A headbox 104 feeds the foamed fiber dispersion hereinbefore described through conduit 103, and is positioned and operative to discharge same through the elongate nozzle 105. Nozzle 105 is fabricated with an upper arcuate wall 106 and an apron lip 107 such that the foam dispensed therefrom is directed onto wire 102. A saveall 120 is positioned with its opening just below the region of the forming wire 102 tangent to and downstream of roll 109.

Breast roll 109 is a hollow cylinder provided with a large number of perforations defined by large diameter outer bores 110 and lesser diameter inner bores 111, the bores being coaxial and whose axes extend radially of the roll 109. A fine mesh screen 112 extends about and closely overlies the perforate outer surface of the roll 109. Inside the roll 109 are a pair of low pressure zones 113, 114 defined by suitable baffles and vacuum producing means of known construction, said baffles being positioned such that the portion of the roll 109 underlying arcuate wall 106 of nozzle 105 is subject to the vacuum in low pressure zone 114. A foil 121 on saveall 120 is positioned in a manner such that removal of liquid from the underside of wire 102 is ensured as it carries the wet web away from the breast roll for subsequent treatment.

In operation, foamed liquid-fiber dispersion is dispensed onto the wire 102, liquid being withdrawn by vacuum zone 113 through both wire and screen, said liquid being stored in bores 110. As wall 109 rotates, wire 102 parts from the surface of the roll 109 the liquid in bores 110 being centrifuged outwardly through the screen 112 into saveall 120. The liquid from the saveall is returned to the silo through line 122.

The webs manufactured by the process disclosed herein comprise at least 10% by weight of the treated fibers described previously, with the remaining 90 to 0% by weight of the web being the aforesaid conventional fibers. Preferably the weight ratio of treated to conventional fibers is in the range of 3:1 to 1:3. Said webs may range in basis weight from 8 to 125 lb./ream. Low basis weight webs, e.g., webs having a basis weight between about 8 and about 50 lbs./ream, are suitable for paper towel, tissue, and napkin products, while heavier basis weight webs, above about 50 lbs./ream, are suitable for paperboard products. For either board or towel, tissue and napkin products, it is within the scope of the invention to obtain final products which comprise two or more plys of lower basis weight webs, said plys being laid sequentially on the same wire before drying, or laminated together after drying.

By including the treated fibers within the webs, the bulk, formation, liquid holding capacity, and softness properties of the web are enhanced. Bulk as used herein is defined as the caliper of an eight ply web in mils divided by the web basis weight in lbs. per 3,000 sq. ft. ream increased eightfold, the caliper being measured at a constant load of 26.6 gms. per sq. cm. using a two inch anvil, unless noted otherwise.

By providing a bulkier web product, typically a product having at least about 10% more bulk than webs of similar basis weight obtained from conventional fibers alone, a significant, concommitant decrease in the amount of fibers needed for a given product is realized. The bulk enhancement arises from the greater interstitial void volume occasioned by the presence of intorted fibers having noticeable three dimensional characteristics. That is, the treated anfractuous fibers cannot lie in a planar orientation as the ribbon-like conventional fibers are apt to do, but rather extend into and out of the plane of the web thereby separating all fibers present in the web. The treated fibers extend both longitudinally and transversely in the plane of the web as well. It is to be understood that the majority of treated fibers do not lie along a particular orthogonal axis of the web, but are randomly distributed in all directions.

The improvement in bulk realized by the incorporation of the treated fibers appears to be dependent on a variety of factors. Firstly, the level of bulk improvement is dependent on the choice of treated fiber preparation method. As between the wet and dry milling procedures previously described, dry milling, as in a hammermill, provides about 15 to 35% greater bulk, other parameters being constant. The reasons for this incremental benefit of dry milled fibers over wet milled fibers are not well understood. However, several possibilities may be advanced. Because dry milled fibers are subjected to high temperatures within the defiberizer means, said treated fibers have a moisture content of less than about 3% by weight, and also receive an electrostatic charge. As a consequence of drying, the dry milled fibers are subjected to additional streses which further provide kinks and curls. It is also possible that such fiber treatment reduces to some extent the relaxation rate of these treated fibers. It is further speculated that bubbles of foam are attracted more easily to the charged dry fibers than to fibers already in a wet condition thereby reducing potential for wetting.

Figure 4:
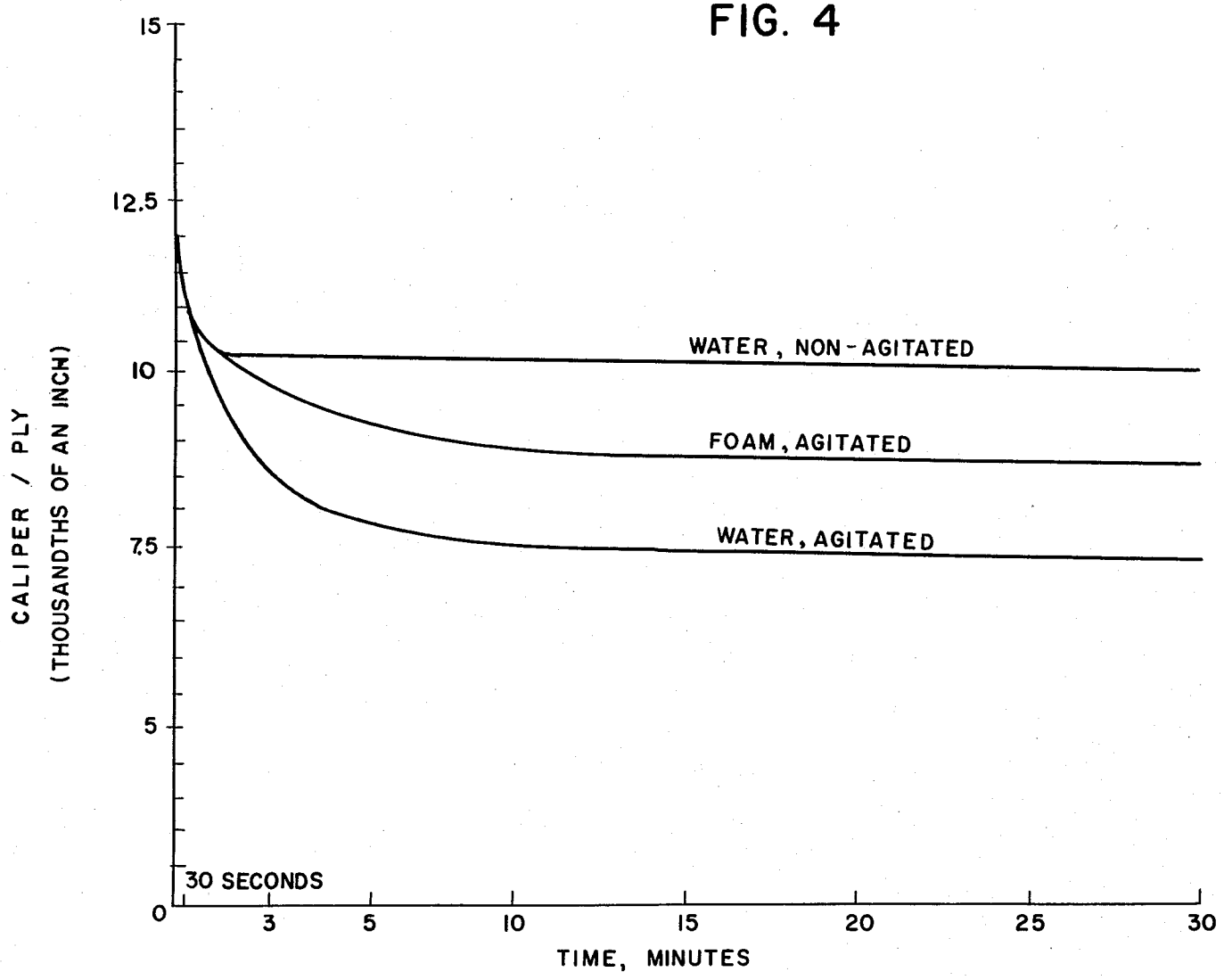
FIG. 4 is a line graph illustrating qualitatively the relationships between residence time of fibers in an aqueous dispersion, the character of the aqueous phase of the dispersion, the effect of agitation and the caliper of the finished web.

The second factor to be considered in achieving high bulk web products is the duration and quality of fiber residence in the mix tank 61. As residence time and turbulence of treated fibers in mix tank 61 increases, bulk of the final web product decreases. Wet milled fibers are more susceptible to the time-mixing quality constraints than dry milled fibers, but in any event, both wet and dry milled fibers lose appreciable bulking potential when placed in an aqueous environment. It has been found that a 0.3 to 4.0% consistency foam furnish can be prepared in mix tank 61 using conventional agitation means, provided that the duration of fibers in the mix tank 61 is limited, on average, to less than about 10 minutes in the case of dry milled fibers, and to less than about 5 minutes for wet milled fibers. As indicated qualitatively in FIG. 4, bulk of the final web products is maximized irrespective of the treated fibers used at the lowest residence time-mixing quality combination that produces substantial dispersion of the treated fibers in the furnish. Preferably, residence time is about 5 and about 3 minutes for dry and wet milled fibers respectively. Residence time in the furnish transport line 78 is neglible because the duration is short as compared to mix tank residence time, and because axial mixing is low. Deflaker 73 residence time is also too low to provide substantial relaxation of treated fiber characteristics.

The third factor which influences the absolute bulk of the web products prepared in accordance with the method disclosed herein is the nature of the post forming operations performed on the wet web. The operations affecting final product bulk are wet pressing by rolls, consolidation to remove residual water in the wet web, couching, drying as on a Yankee or in a through air dryer, creping of the web, calendering of the dry web, and embossing. Certain of these operations reduce wet web bulk; others have no ill effect thereon, and creping apparently improves bulk of the final web product. In each instance the bulk of the product is greater than the bulk of a wet laid web not containing the treated fibers and processed similarly downstream of wet web formation.

As would be expected, compaction of the web in any operation wherein the web is pressed, including for example the compaction provided by drying on a Yankee roll, reduces final web product bulk. However, substantial effect on bulk of the treated fibers remains. In general the bulk of the webs of the present invention which are wet pressed subsequent to forming are approximately equal to the bulk of wet laid webs not containing treated fibers, and which have not been wet pressed, excess water therein being removed by non-contact drying means such as a through air dryer. The bulk of such products is significantly greater than like products of conventional untreated fiber. Of course, the drying load for non-compacted webs is substantially higher than for compacted webs.

It has also been found that bulk lost during compaction is recovered by creping the web, preferably just as the web comes off the Yankee. Apparently, the creping operation, which provides softness to towel and tissue products by breaking excessive hydrogen bonds extant in conventional paper products, releases treated fibers compressed during compaction and locked in place during drying, and allows these fibers to substantially "spring back" to their contorted shape. It should be understood that the treated fibers as defined herein do not lose their anfractuous properties in the dry state.

Although comparisons are at best only guides to the bulk enhancement achieved by the process, the table below illustrates typical results obtained in the preparation of handsheets.

TABLE 1

| Fiber Type | Amount (%) | Forming Media | Bulk (mil/lb./ream) Compacted | Non-Compacted |
|---|---|---|---|---|
| Untreated | 100 | Water | 0.337 | 0.523 |
| Untreated | 100 | Foam | 0.390 | 0.606 |
| Wet Milled | 100 | Foam | 0.457 | 0.762 |
| Dry Milled | 100 | Foam | 0.530 | 0.826 |

Water formed handsheets comprising 100% untreated fibers were formed as follows: The pulp was placed in a British Disintegrator at a consistency of 12.5 g./l. and mixed for 5 minutes. The slurry was then diluted to about 0.3% consistency, and the handsheet formed in a Williams sheet mold. The sheet was removed from the mold using a fabric and vacuum, and then transferred to a blotter. For compacted handsheets, the blotter was placed on a metal plate with the handsheet face up. A wet blotter was placed atop the handsheet, and a second metal plate placed thereon. The metal plates were then passed through an unloaded Appleton Handsheet Calender at low speed. Both non-compacted and compacted handsheets (and first blotter) were dried on a hot plate. Basis weight of sheets thus formed were 15 lbs./ream.

The foam media handsheets were made by preparing a suitable foam in a Denver cell using water and Arco "Ultrawet A-OK" TM surfactant. The foam was transferred to a high speed mixer operating at 15,000 RPM along with sufficient fiber to form the sheet. Mixing was performed for 30 seconds. The foam furnish was then poured into a Williams sheet mold. Subsequent steps were the same as the water formed handsheets.

As indicated in Table 1, above, product bulk apparently is obtained as a consequence of two factors. First, the use of foam increased bulk of untreated webs from 0.337 to 0.390 mil/lb./ream in the case of compacted sheets, and from 0.523 to 0.606 mils/lb./ream for non-compacted sheets, the improvements being 15.7 and 15.8% respectively. Further increases in bulk were obtained in webs made of treated fiber, particularly from dry milled fibers. Compacted webs of wet milled fibers had a bulk improvement as compared with foam formed untreated fibers of 17.2%, while dry milled compacted webs had an improvement of 35.9%. Similar results were observed for non-compacted webs made from the treated fibers.

As the interstitial voids in a web are increased, the absorbency rate of the product web increases, apparently due to decreased resistance to fluid flow. Oil holding capacity increases 50 to 500 percent (based on weight of the oil absorbed per unit weight of dry fiber) as the interstitial voids are increased by the substitution of treated fibers for conventional fibers in the finished web. Water holding capacity also increases as a result of the greater porosity of the webs as determined by the Proposed ASTM Method, submitted to ASTM Committee D-6 entitled "Water Holding Capacity of Bibulous Fibrous Products".

By the process of this invention, the formation of the product web is greatly improved as compared with webs produced by conventional processes that is, the uniformity of the distribution of individual fibers comprising the web is enhanced as observed by absence of flocs in the web upon visual inspection. A better formed web characteristically improves subsequent web processing operations inasmuch as the web is less likely to tear during drying, creping, embossing and the like on a high speed fourdrinier machine. Formation of the web may be measured in a Thwing formation tester under Method No. 525 of the Institue of Paper Chemistry. In this procedure, the degree of uniformity of the web is ascertained by the degree of uniformity of light transmission through an area of the web. The Thwing Index (TI) is the ratio of localized variations in transparency to average transparency. Low basis weight products obtained by conventional web processing methods, e.g., tissue, towel, and napkin products having a basis weight between about 8 to 50 lbs/ream (3000 sq ft), have a TI of between 5 and 15, which values are, of course, dependent upon process conditions and operations. At slower wire speeds, TI values are higher, while at faster speeds, the formation is affected adversely. For webs prepared on a high speed pilot machine in accordance with the process of the present invention, wherein coarser treated fibers are incorporated, TI values were measured at between about 20 to 25, significantly higher than comparative wet laid webs. It is also expected that high bulk products having very high TI values can be made, and that these products can be made at faster wire speeds than those used currently to make low bulk, high TI products.

The tensile strength of the product webs produced by the process of this invention are generally less than those produced by conventional wet pulp papermaking processes. In our process, tensile strength is reduced as the relative proportions of treated fibers to untreated fibers in the product web is increased. The reduction in tensile strength occurs because the treated fibers in the web are less capable of hydrogen bonding than are regular fibers due to reduced active surface area available for bonding. In webs containing 50% by weight or less of the treated fibers, sufficient hydrogen bonding is obtained to provide a product web of adequate strength. Minimum geometric mean tensile strength for products of the present invention would be about 400 gm/3" strip, although preferably minimum geometric mean tensile would be between 400 to about 700 gm/3" strip sufficient to meet acceptible standards applicable to the particular end use. For certain products, for example, low basis weight tissue and towel products, high tensile strength due to hydrogen bonding is disadvantageous; webs produced by conventional processes are often creped to eliminate excessive hydrogen bonding and to provide softness. With webs containing more than 50% by weight of treated fibers, a bonding agent may be used to provide added tensile strength as required by the ultimate end use. Suitable bonding agents include cationic starch; polyvinyl alcohol; pearl starch; natural gums (tragacanth, karaya, guar); natural and synthetic latex, including polyacrylates, e.g. polyethylacrylate, and copolymers; vinyl acetate-acrylic acid; copolymers; polyvinylacetates; polyvinyl chlorides; ethylene-vinyl acetates; styrene-butadiene carboxylates; polyacrylonitriles; and thermosetting cationic resins, eg. urea formaldehyde resins, melamine formaldehyde resins, glyoxalacrylamide resins and polyamide-epichlorhydrin resins as disclosed in U.S. Pat. No. 3,819,470. Bonding materials are desirable where the conventional fibers used in the web are not self-bonding, as in certain synthetic and chemically modified cellulosic fibers.

EXAMPLE I

A series of three runs were made on a high speed twin wire paper machine at about 1000 fpm. One run was a control using repulped Ontario Softwood Kraft (OSWK) fibers that had been refined to 400 CSF. Two subsequent runs were made using 100% dry milled fibers comprising a mixture of softwood spruce fibers from Stora-Koppersburg and Rayfloc XJ southern softwood fibers from Ranier Corporation (hereinafter Stora-XJ fibers) said fiber mixture having been treated previously with a debonding agent. In each run the Stora-XJ fibers were added directly to the mix tank, the furnish therein being at 1.8% consistency. Headbox consistency was adjusted to 0.45% by dilution with foamed liquid from the silo. Arco "Ultrawet A-OK" surfactant was used to generate the foam in all runs. The amounts of fiber used in each run was such as to obtain product webs of comparable basis weights. The webs were wet pressed and subsequently dried and creped on a Yankee dryer, but were not calendered.

Web properties for each run are tabulated below:

TABLE 2

| Run No. | 1 | 2 | 3 |
|---|---|---|---|
| Fiber Type | 100% OSWK | | 100% Stora-XJ |
| Basis Weight, lb/ream | 35.6 | 35.7 | 38.3 |
| 8-Ply Caliper, mils | 77.5 | 157.3 | 147.3 |
| Bulk, mil/lb/ream | 0.272 | 0.551 | 0.481 |
| Percentage Solids on Wire: | | | |
| Before Vacuum | 8.8 | 20.2 | n/a |
| After Vacuum | 15.7 | 31.9 | n/a |
| % Solids on Felt | 19.8 | 23.3 | n/a |
| % Solids at Yankee | 43.7 | 57.9 | n/a |
| Instron Dry Tensile, g/7.62 cm | | | |
| MD | 9840 | 146 | 385 |
| CD | 3148 | 56 | 221 |
| MD/CD | 3.1 | 2.6 | 1.7 |
| Instron Elongation, percent: | | | |
| MD 31.2 | 17.7 | 25.9 | |
| CD | 3.6 | 8.0 | 5.2 |
| Oil Holding Capacity Ratio g oil/g fiber | 3.13 | 9.24 | 7.23 |

Although substantial improvement in bulk was realized for both webs made of Stora-XJ fibers, these webs had low tensile properties. Low tensiles were expected inasmuch as dry treated fibers have low fiber bonding tendency. Further, the presence of debonder lowered bonding even more. The high tensiles of the OSWK web is attributable to the refining of OSWK fibers prior to their use. A comparison of the percent solids data for runs 1 and 2 indicates that water drainage was superior from the pores, high bulk web comprising the treated fibers. Similarly, the high bulk of the webs of runs 2 and 3 provided significantly higher oil holding capacity for these webs.

EXAMPLE II

Test runs were made on a high speed twin wire paper machine operating at 1500 fpm. In each run a pulp of 3.5% consistency was made comprising 50% OSWK and 50% OHWK untreated fibers. Treated fibers were not included in these runs, which are controls. After pulping the slush pulp was pressed to 28% consistency and added to the mix tank, and a foam furnish of about 0.6% fiber by weight delivered to the headbox. Air content ranged between 58 to 70%. The webs were wet pressed, dried and creped. In Runs 5 and 6 the webs were calendered.

Properties of these webs are tabulated below:

TABLE 3

| Run No. | 4 | 5 |
|---|---|---|
| Fiber Type | 50% OSWK/50% OHWK | |
| Calender Roll Pressure, psig. | 5.0 | 4.3 |
| Basis Weight, lb/ream | 14.2 | 17.6 |
| 8 Ply Caliper, Mils | 45.9 | 47.1 |
| Bulk, mil/lb/ream | 0.404 | 0.335 |
| Instron Dry Tensile, g/7.62 cm | | |
| MD | 429 | 732 |
| CD | 275 | 542 |
| MD/CD | 1.6 | 1.35 |
| Instron Elongation, %: | | |
| MD | 26.4 | 24.3 |
| CO | 4.8 | 3.7 |

EXAMPLE III

A series of eight runs were made on the high speed twin wire machine at 1500 fpm. The webs were made with a blend of OSWK and Stora-XJ fibers in accordance with the present process except that the treated fibers were admixed in the pulp tank for about five minutes rather than direct dispersion in the mix tank. One set of runs (Group A) contained a 50-50 mixture of the aforesaid fibers; the runs of Group B comprised 72% treated fibers and 28% untreated fibers. Webs in both sets of runs were formed at a consistency of about 0.60% fiber by weight, and the air content of the foam was about 65–66% at the headbox. The wet webs were pressed, transferred to a felt, and dried and creped. Each web was calendered at roll pressures of between 2 and 8 psig, as noted. It should be understood that the five minute mixing period for those runs involving pulp tank addition of the treated fibers is considerably less than the pulp preparation time in commercial facilities. Even so this unusually short period of treated fiber high shear mixing produced a noticeable decrease in bulk. For example, Run 6 provided a web of 0.432 mil/lb-/ream as compared to bulks of 0.463 and 0.457 for the webs of Runs 15 and 16, respectively, in Example IV.

The web properties are tabulated below:

TABLE 4

| | GROUP A | | | GROUP B | | | | |
|---|---|---|---|---|---|---|---|---|
| Run No. | 6 | 7 | 8 | 9 | 10 | 11 | 12 | 13 |
| Fiber Type | 50% OSWK/50% STORA-XJ | | | 28% OSWK/72% STORA-XJ | | | | |
| Calender Pressure, psig | 2 | 5 | 8 | 2 | 2 | 2 | 5 | 8 |
| Basis Weight, lb/ream | 18.0 | 17.5 | 17.6 | 16.8 | 18.6 | 17.9 | 16.5 | 16.6 |
| 8 Ply Caliper, Mils | 62.2 | 58.2 | 51.7 | 68.3 | 68.4 | 70.3 | 63.4 | 59.3 |
| Bulk, Mil/lb/ream | 0.432 | 0.416 | 0.367 | 0.508 | 0.460 | 0.491 | 0.480 | 0.446 |
| Instron Dry Tensile, g/7.62 cm | | | | | | | | |
| MD | 1485 | 1334 | 1403 | 390 | 533 | 540 | 454 | 504 |
| CD | 965 | 850 | 881 | 397 | 533 | 540 | 454 | 504 |
| Instron Elongation, % | | | | | | | | |
| MD | 40.7 | 39.2 | 36.8 | 40.5 | 37.0 | 36.5 | 32.6 | 32.2 |
| CD | 4.9 | 4.5 | 4.6 | 5.3 | 4.7 | 5.7 | 6.0 | 6.6 |

EXAMPLE IV

A series of four runs were made on the high speed twin wire machine at 1500 fpm. The webs were made with a blend of OSWK and Stora-XJ dry milled fibers in accordance with the process of this invention. The milled fibers were added to the mix tank. The four runs used a 50/50 blend of said fibers, and the webs were formed at a consistency of 0.6 percent, the foam having an air content of 67 at the headbox. The wet webs were pressed, transferred to a felt, dried and creped.

The webs were calendered as noted below and had the properties tabulated:

TABLE 5

| Run No. | 14 | 15 | 16 | 17 |
|---|---|---|---|---|
| Fiber Type | 50% OSWK/50% Stora-XJ | | | |
| Calendering Roll Pressure, psig | 0 | 2 | 2 | 5 |
| Basis Weight, lb/ream | 19.5 | 17.8 | 18.9 | 18.3 |
| 8-Ply Caliper, Mils | 87.8 | 65.9 | 69.1 | 63.3 |
| Bulk, Mil/lb/ream | 0.563 | 0.463 | 0.457 | 0.432 |
| Instron Dry Tensile, g/7.62 cm | | | | |
| MD | 628 | 742 | 748 | 842 |
| CD | 475 | 602 | 539 | 596 |
| MD/CD | 1.3 | 1.2 | 1.4 | 1.4 |
| Instron Elongation, % | | | | |
| MD | 37.8 | 36.2 | 39.5 | 37.7 |
| CD | 5.9 | 5.0 | 6.1 | 5.7 |

EXAMPLE V

Eleven runs were made on the high speed machine operating at 1000 fpm using a foamed liquid furnish. The treated fibers used therein were introduced at the mix tank. Runs 18 to 20 were controls using 100% untreated OSWK fibers refined to 480 CSF. Runs 21 to 24 contained a mixture of 50 percent untreated OSWK fibers and 50 percent dry milled Stora-XJ fibers as previously described, while runs 27 to 30 contained 20 percent untreated and 80 percent treated fibers.

TABLE 6

| Run No. | 18 | 19 | 20 | 21 | 22 | 23 | 24 | 25 | 26 | 27 | 28 |
|---|---|---|---|---|---|---|---|---|---|---|---|
| Fiber Type | 100% OSWK | | | 50% OSWK 50% STORA-XJ | | | | 20% OSWK 80% STORA-XJ | | | |
| Calendered | No | No | Yes | No | No | Yes | Yes | No | | | |

TABLE 6-continued

| Run No. | 18 | 19 | 20 | 21 | 22 | 23 | 24 | 25 | 26 | 27 | 28 |
|---|---|---|---|---|---|---|---|---|---|---|---|
| Basis Weight, lb/ream | 14.9 | 27.4 | 14.3 | 12.9 | 15.3 | 14.5 | 14.8 | 18.3 | 19.9 | 25.4 | 27.5 |
| 8-Ply Caliper, Mils | 57.5 | 72.7 | 51.0 | 66.4 | 72.8 | 69.0 | 70.9 | 104.7 | 112.4 | 110.6 | 112.0 |
| Bulk, Mils/lb/ream | 0.482 | 0.332 | 0.446 | 0.643 | 0.595 | 0.595 | 0.599 | 0.715 | 0.706 | 0.544 | 0.509 |
| Dry Tensile, g/7.62 cm | | | | | | | | | | | |
| MD | 1172 | 4148 | 999 | 288 | 354 | 470 | 249 | 137 | 149 | 471 | 417 |
| CD | 619 | 2133 | 565 | 152 | 176 | 212 | 128 | 59 | 66 | 221 | 226 |
| Elongation, % | | | | | | | | | | | |
| MD | 35.7 | 36.5 | 32.5 | 27.2 | 27.3 | 32.3 | 26.8 | 23.0 | 21.9 | 25.5 | 23.6 |
| CD | 4.6 | 3.1 | 4.7 | 7.9 | 8.1 | 7.1 | 8.8 | 10.9 | 9.4 | 5.2 | 5.6 |

The preceding disclosure is to be considered exemplary of the invention disclosed therein, the scope of said invention being defined by the claims appended below.

We claim:

1. A process for the production of a fibrous web which comprises:

(a) forming treated hydrophilic papermaking fibers characterized by twists, kinks and curls and having the ability to retain their characteristic shapes for only a relatively short period of time when wet with water by subjecting substantially dry natural cellulosic papermaking fibers to mechanical deformation by hammermilling without substantial fibrilation or breakage of the fibers;

(b) forming a dispersion comprising said dry treated fibers in an aqueous foam capable of supporting and transporting said fibers; and (c) forming a dewatered fibrous web from said dispersion within a period of time within the range of 0.5 to 5 minutes following the addition of said dry treated fibers to said aqueous foam.

2. A process according to claim 1 wherein said dispersion is formed with low shear agitation.

3. A process according to claim 1 wherein said dispersion has a consistency of from about 0.3 to about 1.2 percent fiber by weight.

4. A process according to claim 1 wherein said dispersion comprises a mixture of said treated fibers and conventional papermaking fibers and wherein said treated fibers comprise at least 10 percent by weight of all fibers present in said dispersion.

5. The process of claim 1 wherein the treated hydrophilic papermaking fibers comprise cellulose ester fibers having a degree of substitution of hydroxyl groups therein of less than 1.0.

6. The process of claim 1 wherein the moisture content of the treated fibers leaving the hammermill is preferably between 0.5 and 3.0% by weight.

7. The process of claim 6 wherein the foamed dispersion contains from about 55 to about 75% air by volume, the air being present as dispersed bubbles in the size range of from about 20 to about 200 microns.

8. The process of claim 7 further comprising the steps of dispersing the conventional papermaking fibers in aqueous foam to form a first dispersion, admixing said treated fibers with said first dispersion, and adding aqueous foam as diluent to produce a dispersion containing 0.3 to 1.2 percent fiber by weight.

9. The process of claim 8 wherein the consistency of the foamed dispersion before addition of diluent is from about 1.5 to about 3.5 percent fiber by weight.

10. The process of claim 4 wherein the treated fibers comprise from about 25 to about 75 percent by weight of all fibers present in the dispersion.

11. The process of claim 2 wherein the residence time of the treated fibers in the aqueous dispersion is not more than about 3 minutes.

12. The process of claim 1 wherein the basis weight of the product web thus formed is less than 75 pounds per ream and the bulk of said web is greater than 0.45 mils/pound/ream.

13. The process of claim 1 wherein the water content of the wet web is between 80 to 93% by weight.

* * * * *

UNITED STATES PATENT AND TRADEMARK OFFICE

CERTIFICATE OF CORRECTION

PATENT NO. : 4,488,932

DATED : Dec. 18, 1984

INVENTOR(S) : Robert Eber, et al.

It is certified that error appears in the above-identified patent and that said Letters Patent is hereby corrected as shown below:

Col. 7, line 40, "16" should read: -- 26 --.

Col. 16, line 51, of Table 2: "31.2" should be under column 1

"17.7" should be under column 2

"25.9" should be under column 3

Signed and Sealed this

*Fourteenth* Day of *May 1985*

[SEAL]

*Attest:*

DONALD J. QUIGG

*Attesting Officer*

*Acting Commissioner of Patents and Trademarks*